US006557590B2

(12) United States Patent
Swers et al.

(10) Patent No.: US 6,557,590 B2
(45) Date of Patent: May 6, 2003

(54) DECORATIVE OUTDOOR FABRICS

(75) Inventors: David N. Swers, Chapel Hill, NC (US); Johnny E. Parrish, Anderson, NC (US)

(73) Assignee: Glen Raven, Inc., Glen Raven, NC (US)

( * ) Notice: Subject to any disclaimer, the term of this patent is extended or adjusted under 35 U.S.C. 154(b) by 282 days.

(21) Appl. No.: 09/740,320

(22) Filed: Dec. 18, 2000

(65) Prior Publication Data

US 2001/0039158 A1 Nov. 8, 2001

Related U.S. Application Data

(63) Continuation-in-part of application No. 09/525,285, filed on Mar. 15, 2000, now Pat. No. 6,161,596, which is a continuation of application No. 09/222,529, filed on Dec. 29, 1999, now Pat. No. 6,092,563.

(51) Int. Cl.[7] ..... D03D 15/00

(52) U.S. Cl. ..... 139/420 A; 139/42 R; 442/200

(58) Field of Search ..... 139/420 R, 420 A, 139/426 R; 442/150, 198, 200, 203, 208, 209; 28/115, 109, 107, 112, 220

(56) References Cited

U.S. PATENT DOCUMENTS

| | | | | |
|---|---|---|---|---|
| 4,080,777 | A | 3/1978 | Griset, Jr. | 57/140 J |
| 4,160,057 | A | 7/1979 | Kogan et al. | 428/245 |
| 4,212,152 | A | 7/1980 | Roman | 57/207 |
| 4,276,348 | A | 6/1981 | Wu et al. | 428/373 |
| 4,406,310 | A | 9/1983 | Reader et al. | 139/420 R |
| 4,430,852 | A | 2/1984 | Hatcher | 57/247 |
| 4,534,164 | A | 8/1985 | Toshimasa et al. | 57/290 |
| 4,830,907 | A | 5/1989 | Sawyer et al. | 428/225 |
| 4,839,228 | A | 6/1989 | Jezic et al. | 428/401 |
| 5,104,703 | A | 4/1992 | Rachman et al. | 428/35.6 |
| 5,187,005 | A | 2/1993 | Stahle et al. | 428/252 |
| 5,190,809 | A | 3/1993 | Marissen et al. | 428/225 |
| 5,192,601 | A | 3/1993 | Neisler | 428/120 |
| 5,199,141 | A | 4/1993 | Trask et al. | 28/115 |
| 5,271,992 | A | 12/1993 | Siener, Jr. et al. | 428/204 |
| 5,284,704 | A | 2/1994 | Kochesky et al. | 428/296 |
| 5,305,813 | A | 4/1994 | Poole | 160/236 |
| 5,397,622 | A | 3/1995 | Thomas | 428/192 |
| 5,454,142 | A | 10/1995 | Neely et al. | 28/104 |
| 5,464,684 | A | 11/1995 | Vogelsang et al. | 428/229 |
| 5,536,551 | A | 7/1996 | Woosley | 428/92 |
| 5,617,903 | A | 4/1997 | Bowen, Jr. | 130/383 A |
| 5,651,168 | A | 7/1997 | Tung et al. | 28/220 |
| 5,698,480 | A | 12/1997 | Geiman et al. | 442/181 |
| 5,712,209 | A | 1/1998 | Geiman et al. | 442/208 |
| 5,721,179 | A | 2/1998 | Shi et al. | 442/203 |
| 6,117,548 | A | 9/2000 | Swers et al. | 428/370 |

FOREIGN PATENT DOCUMENTS

| | | | |
|---|---|---|---|
| EP | 629724 | 11/1995 | D03D/15/00 |
| EP | 816554 | 2/1998 | D03D/15/00 |

*Primary Examiner*—A. Vanatta
*Assistant Examiner*—Robert H. Muromoto
(74) *Attorney, Agent, or Firm*—Womble Carlyle Sandridge & Rice, PLLC

(57) ABSTRACT

A decorative outdoor fabric including a woven structure formed of warp effect yarns and at least some of the fill yarns comprising self-coating yarns formed of high melt and low melt yarn constituents. When the fabric is tentered, the low melt constituents melt and cross-flow to the other fibers in the fill and warp yarns. Both the warp yarns have deniers in the range of 50–4000 and the fill yarns have deniers in the range of 150–4000. Because of the cross-flow of the low melt constituents, the resulting fabric achieves acceptable abrasion resistance, stability, and load recovery and hand without the need for a latex backing.

32 Claims, 2 Drawing Sheets

DECORATIVE OUTDOOR FABRICS

RELATED APPLICATIONS

This application is a Continuation-In-Part of application Ser. No. 09/525,285, filed Mar. 15, 2000 now U.S. Pat. No. 6,161,596, issued Dec. 19, 2000, which in turn is a Continuation of Ser. No. 09/222,529, filed Dec. 29, 1999 U.S. Pat. No. 6,092,563 issued Jul. 25, 2000.

FIELD OF THE INVENTION

The present invention relates to decorative outdoor fabrics and particularly to fabrics of the type having a relatively open structure, such as "sling" fabric for casual furniture. More particularly, the invention relates to an outdoor fabric formed of acrylic, polyester, polypropylene, or nylon effect yarns in the warp and composite self-coating stabilizing yarns in part or all of the fill which upon melting of the low melt constituent, impart to the fabric greater abrasion resistance, load/elongation recovery, firmer hand and weave stability without the application of a latex backing.

BACKGROUND OF THE INVENTION

Novelty or decorative weave fabrics are often characterized by long floats in the weave pattern, resulting in a relatively open structure in which fabric stability is a problem. This occurs in shade applications and outdoor cushion upholstery. Other outdoor fabrics such as "sling" fabrics for outdoor furniture, and fabric for tents, awnings, and marine applications must have the additional characteristics of abrasion resistance, high strength and load/elongation recovery. Conventional decorative weave fabrics do not exhibit these characteristics without difficulty and expense. Because the fabrics typically are used for outdoor applications they should also be colorfast and non-yellowing. Meeting these requirements requires that the fabric have a prescribed degree of UV resistance.

Decorative weave fabrics, as previously manufactured, are prone to undergo weave stability problems because of their open structure and sometimes the rough use to which they are subjected. For example, the warp and fill yarns may tend to slip and sag and not maintain their desired parallel relationship the fabric may also suffer from seam slippage and raveling. In the past, these open structures have either been formed of relatively stiff yarns; or else they have been formed of softer yarns which have been stabilized by applying a latex coating on the backside of the fabric. Utilization of a latex coating requires specialized machinery and, of course, extra cost for the latex material. Further, this approach requires slower tenter speeds and, occasionally, multiple passes of the fabric through the tenter to achieve proper coating. The resulting fabric is extremely stiff and has but one aesthetically acceptable side, thus limiting its applicability.

In many applications, such as sling fabrics, awnings, and marine tops, both sides must be visible and colored to be aesthetically pleasing. Further, in many applications, it is desirable to use a continuous lay down in the pattern cutting operation, wherein the fabric is folded to form multiple layers and cut. This exposes alternate sides in the finished products. A one-sided fabric, as is the case in latex backed fabrics, prohibits taking advantage of these concerns.

The problems described above have limited the use of soft yarns in the woven decorative fabrics, because such constructions have not been able to provide an economically feasible fabric capable of meeting the required performance standards without the use of the aforesaid latex backing or very heavy constructions. Thus, softer acrylic yarns have not been used as a "sling" fabric in the casual fabric market. The term "sling fabric" as used here refers to outdoor fabrics having a relatively open weave and used as the seat and back of outdoor furniture without underlying cushioning. These fabrics are typically woven utilizing PVC coated polyester or PVC/acrylic blends in the 500–1000 denier range. This fabric is woven and attached to the rigid frames which make up the casual furniture.

SUMMARY OF THE INVENTION

The present invention therefore is directed to a more open weave outdoor fabric, formed of softer yarns than previously, yet a fabric that provides enhanced abrasion resistance, load/elongation recovery, weave stability, and allows a much broader variety of designs.

The decorative fabric of the present invention therefore includes a woven structure of warp and fill yarns in which at least some of the fill yarns are self-coating composite yarns formed of high melt and low melt yarn constituent. The high melt and low melt constituents are blended or air textured together, so that upon heating in the tentering operation, the low melt constituents melt, cross-flow to the high melt yarns "self coating", and bond the warp and fill yarns at the intersections to achieve stability. The fill yarns have a denier of at least 400 d. The warp yarns (effect) used in the fabric of the present invention conventionally are acrylic, polyester, high melt polypropylene, or nylon and also have a denier of at least 50 d. The composite yarns include high melt constituents which may be acrylic, polyester, nylon, or high melt polypropylene, while the low melt constituents are, polyethylene or low melt polypropylene. The resulting fabric achieves an acceptable abrasion resistance, stability, and load recovery without the need for latex backing.

The resulting fabric often achieves an abrasion resistance preferably of greater than 9000 double rubs, seam slippage of greater than 40 lbs., and load recover of at least 95%. While the specifications above are preferable, acceptable fabrics can be, in some cases, realized in which the abrasion resistance is 6000 double rubs and the load recover is 90%. Further, the yarn ends of the self-coating yarns demonstrate minimal or zero raveling.

It is therefore an object of the present invention to provide an improved decorative outdoor fabric suitable for use in tents, awnings, marine applications, and in outdoor furniture.

It is another object to the present invention to provide a fabric of the type described which may be formed principally of acrylic, polyester, olefin, or nylon yarns, and require no latex backing.

Another object of the invention is to provide fabrics of the type described which, when formed by the same construction as previously known, achieve improvements in key specifications as a result of the use of the self-coating yarns.

Still another object of the invention is to provide decorative outdoor fabrics with lighter weight, more open weaves, and lower costs.

It is yet another object of the present invention to provide a fabric of the type described which can be relatively open structure, and yet achieves comparable abrasion resistance, stability, and load recovery, as compared to outdoor fabric formed of other yarns or formed of acrylic yarns with latex backing.

BRIEF DESCRIPTION OF THE DRAWINGS

The above and other objects, features, and advantages of the present invention will become more apparent and will be readily appreciated from the following detailed description of the preferred embodiments of the invention, taken in conjunction with the accompanying drawings in which.

DESCRIPTION OF THE PREFERRED EMBODIMENTS

Figure 1:
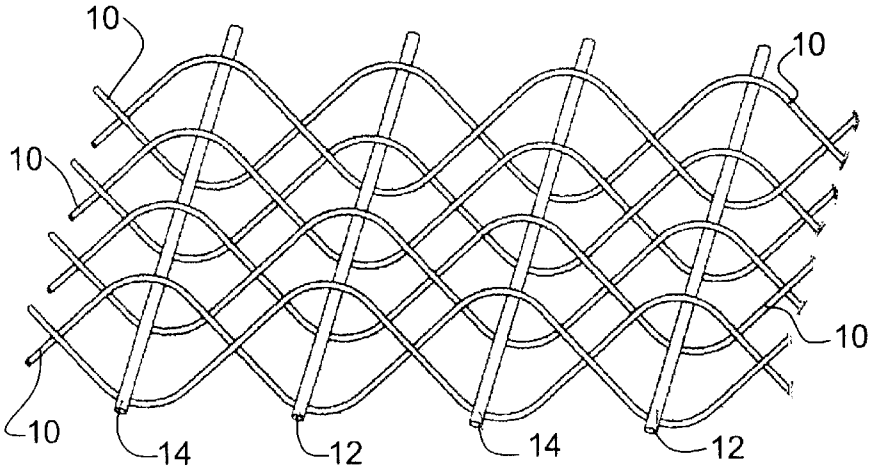
FIG. 1 is a schematic representation of a weave diagram illustrating a 1×1 pick pattern in which the self-coating yarn is provided in alternate fills.

The decorative fabric according to the present invention is formed of effect yarns and a stabilizing yarn. An "effect yarn" is a conventional yarn selected because of the effect it achieves in the fabric, and as aesthetics or hand. One example of an effect yarn is acrylic. The term "stabilizing" yarn is used herein to mean a yarn that achieves a utilitarian result encompassing such characteristics as abrasion resistance, load recovery or weave stability. The stabilizing yarn is in reality a unique self-coating yarn comprising both low melt and high melt constituents. The term "low melt" constituent is intended to mean fibers or filaments (polyethylene or low melt polypropylene) having a melt temperature in the range of 240–280° F. The term "high melt" constituent is intended to mean fibers or filaments having a melt temperature at least 40°–60° F. higher than the melt temperature of the low melt constituent with which it is intended to be used. Examples of high melt constituents include acrylic, polyester, nylon and high melt polypropylene. Thus, if the melt temperature of the low melt constituent is 260° F., the high melt constituent should be selected to have a melt temperature of at least 310° F.

The high melt fibers or filament in the stabilizing yarn is preferably acrylic, although polyester, nylon or such olefins as high melt polypropylene could also be used. The low melt constituent is preferably polyethylene, low melt polypropylene or other low melt olefins. The composite yarn formed preferably includes deniers in the range of 400–4000 d.

The resulting yarn provides a fabric that is extremely abrasion resistant and will meet standards of up to and exceeding 9,000 double rubs. Further, such yarns create a fabric that is extremely resistant to slippage. By the term "slippage resistant," it is meant that fabrics formed from such yarns, when subjected to an Instron slippage test will be able to withstand forces of 40 lbs. And greater without seam slippage, whereas conventionally known decorative outdoor fabrics made without a latex backing and without the self-coating yarns can only withstand about 20 lbs. Of force. Also, such fabrics will realize load recovery (dimensional stability) to 95% and greater, whereas conventionally formed fabrics can only achieve about 80% load recover.

The composite or compounded yarns may be formed in either of two ways. One or more continuous low melt filament ends can be combined with one or more ends of high melt fibers or filaments with the ends air textured. Alternatively, low melt and high melt fibers may be homogeneously blended or mixed, then processed according to standard blended yarn forming procedures. In either technique, the amount of low melt constituent should be in the range of 10%–50% of the entire weight of the yarn. While the higher percentages (20%–50%) induce more cross-flow and binding of fibers and filaments exhibit greater abrasion resistance, weave stability, and load recover, they adversely effect hydrostatic resistance in yarns formed by the blending of staple fibers method and therefore are used for outdoor fabrics. On the other hand yarns of lower percentages (10–15%) of low melt constituents as are used in the yarns formed of blended staple fibers, are utilized in tents, awnings, and marine applications because they must be more and are water repellant. These lower levels will not adversely affect hydrostatic resistance.

Figure 2:
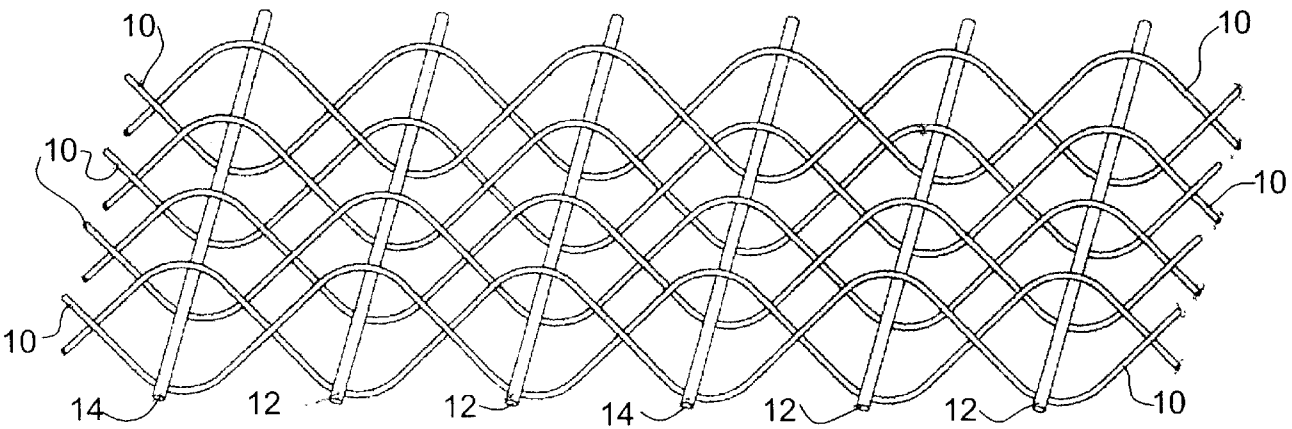
FIG. 2 is a schematic representation similar to FIG. 1 except illustrating a 1×2 pick pattern in which the self-coating yarn is used in every third fill.
Figure 3:
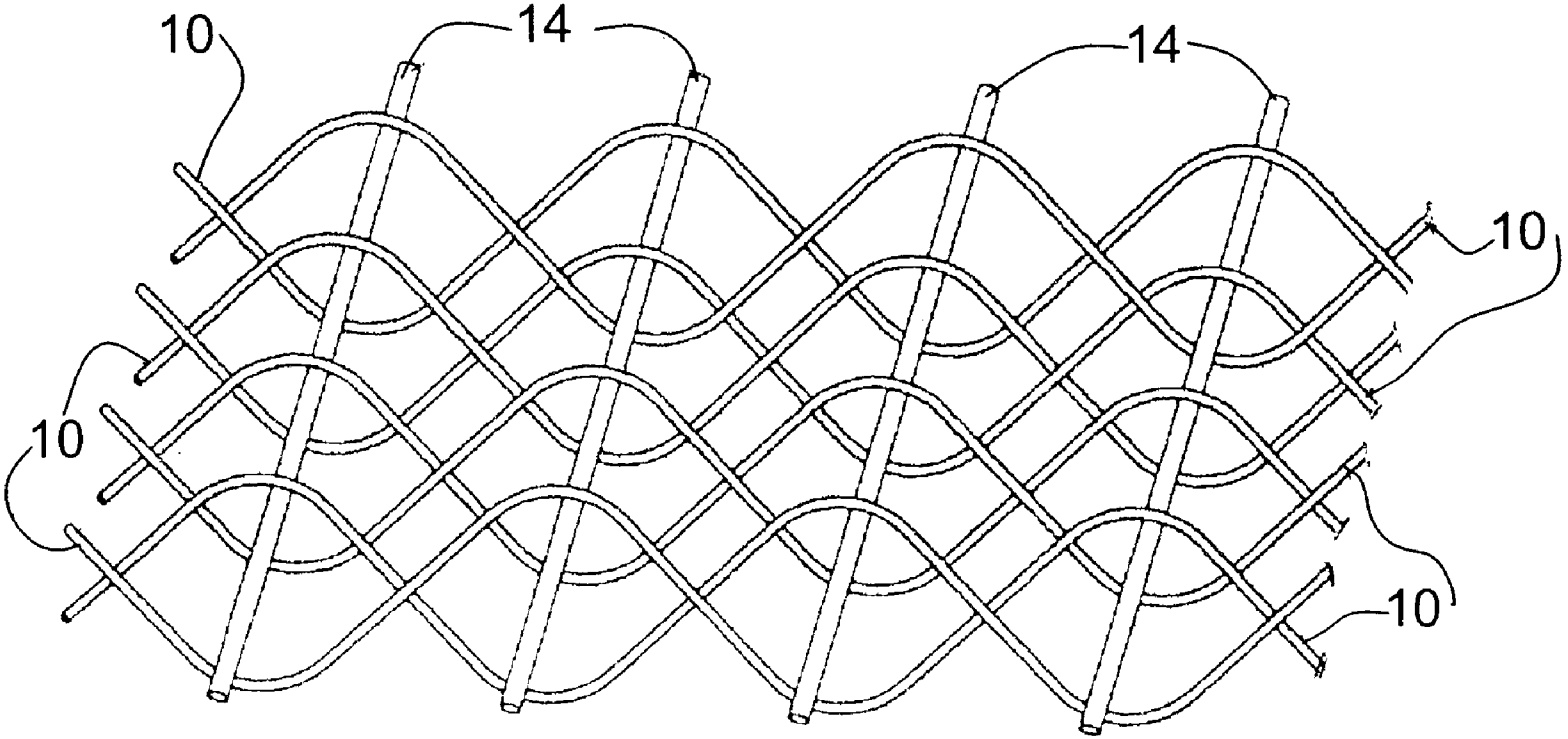
FIG. 3 is a schematic representation in which the self-coating yarn is utilized in every fill.

The fabric may be formed in accordance with several weaving patterns as illustrated in FIGS. 1–3. In each embodiment, the warp yarns are effect yarns and are preferably acrylic. In FIG. 1, while the warp yarns 10 are all acrylic, in the fill direction, acrylic yarns 12 are alternated with the self-coated composite yarns 14 (1×1 pattern insertion). This is considered to be a pattern insertion which results in 2.5–12.5% low melt constituent depending on the amount of low melt material in the composite yarns, and yields a sturdy bond and a full body hand.

In FIG. 2, a 1×2 pattern insertion is utilized wherein there is one composite yarn 14 for every two picks of acrylic yarns 12. This results in 1.25–6.25% low melt constituent and yields a light bond and the softest hand.

In FIG. 3, there is illustrated a pattern in which the composite yarns are inserted in 100% of the fills. This pattern results in 5–25% low melt constituent and yields a hard bond and a firm hand.

In the table below, several different samples have been subjected to comparison testing to illustrate the differences in abrasion, seam slippage, and raveling of fabrics formed with the yarns of the present invention. In each sample, samples of the fabric are woven with conventional yarns in the warp direction. Each example differs slightly.

Sample 1 utilizes acrylic as the effect yarn and a stabilizing yarn combining high melt polypropylene as the high melt constituent and polyethylene as the low melt constituent. Two filaments of polypropylene are air textured around a core of the polyethylene filament. Acrylic is used a warp yarns and the polypropylene/polyethylene stabilizing yarns used with acrylic fill yarns in a 1×1 insertion pattern.

Sample 2 is an all acrylic yarn weave construction back coated with latex.

Sample 3 is also an all acrylic yarn weave construction, but is not back coated.

Sample 4 utilizes acrylic as the effect yarn and a stabilizing yarn formed of 90% high melt acrylic fibers and 10% low melt polyethylene fibers. The high melt and low melt fibers are blended according to conventional blended yarn forming practices. Then the 90/10 blended stabilizing yarn is inserted at every pick.

Sample 5 is similar to Sample 1 except the polypropylene/polyethylene stabilizing yarn is used in each pick of the fill.

Sample 6 is made exactly as Sample 5, except the testing of the fabric occurred before heat setting.

| | Abrasion | Seam Slippage | Raveling |
|---|---|---|---|
| Sample #1 | W-15,000<br>F-15.000 | 100 + lbs. | Excellent |
| Sample #2 | W-25,000<br>F-25,000 | 76.2 | Excellent |
| Sample #3 | W-3000<br>F-15,000 | 29.6 lbs. | Poor |

-continued

| | Abrasion | Seam Slippage | Raveling |
|---|---|---|---|
| Sample #4 | W-6000<br>F-15,000 | 39.6 lbs. | Good |
| Sample #5 | W-15,000<br>F-15,000 | 100 + lbs. | Excellent |
| Sample #6 | W-3000<br>F-12,000 | 35 lbs. | Poor |

As can be seen, samples 1, 2, 4, and 5 provide the best results. Sample 3, which utilizes conventional fill yarns without the self-coating yarns, exhibit relatively poor abrasion resistance, seam slippage, and raveling results. Sample 6 illustrates the importance of cross-flow which results from heat setting, as in Sample 5.

Sample 7 utilizes 18/2 acrylic yarns as the effect yarn for the warp. The fill includes alternating picks of 650 denier or 800 denier high melt polypropylene and stabilizing yarns formed of ends of high melt polypropylene and polyethylene (low melt) air textured together. Preferred sizes of the stabilizing yarn for this example are 625 denier, and 1,300 denier. The fill yarns may be introduced from 16–22 picks per inch.

Sample 8 utilizes 220 denier high melt polypropylene as the effect yarn for the warp. The fill pattern includes alternating picks of 18/2 acrylic as the effect yarn and stabilizing yarns again formed of high melt polypropylene filaments and polyethylene filaments air textured together at deniers of 625 and 1,300. The fill yarns are introduced at 30 picks per inch.

Sample 9 utilizes 18/2 acrylic yarns as the effect yarn for the warp. The fill includes alternating picks of 18/2 acrylic as an effect yarn and stabilizing yarns formed of ends of high melt polypropylene and polyethylene air textured together. Preferred sizes of the stabilizing yarn for this example are 625 denier and 600 denier. The fill yarns are introduced at 24–38 picks per inch.

Sample 10 utilizes 650 denier high melt polypropylene as the effect yarn for the warp. The fill includes alternating picks of 650 denier high melt polypropylene as an effect yarn and stabilizing yarns formed of ends of high melt polypropylene and polyethylene air textured together. Preferred sizes of the stabilizing yarn for this example are 625 denier and 1,300 denier. The fill yarns may be introduced at 16–20 picks per inch.

Sample 11 utilizes 50 denier polyester as the effect yarn for the warp. The fill includes alternating picks of 650 denier high melt polypropylene as an effect yarn and stabilizing yarns of high melt polypropylene and polyethylene filaments air textured together at deniers of 625 and 1,300. The fill yarns are introduced at 30–36 picks per inch.

Sample 12 utilizes 18/2 acrylic as the effect yarn for the warp. The fill includes alternating picks of 650 denier high melt polypropylene as an effect yarn and stabilizing yarns formed from ends of polyester and polyethylene air textured together. Preferred sizes of the stabilizing yarn for this example are 625 and 1,300 denier. The fill yarns are introduced at 16–24 picks per inch.

Sample 13 utilizes 220 denier high melt polypropylene as the warp effect yarn. The fill pattern includes alternating picks of 18/2 acrylic as the effect yarn and stabilizing yarns again formed of polyester and polyethylene at deniers of 625 and 1,300. The fill yarns are introduced at 30 picks per inch.

Sample 14 utilizes 18/2 acrylic as the warp effect yarn. The fill pattern includes alternating picks of 18/2 acrylic as the effect yarn and stabilizing yarns again formed of polyester and polyethylene filaments air textured together at deniers of 625 and 1,300. The fill yarns are introduced at 24–38 picks per inch.

Sample 15 utilizes 650 denier polypropylene yarn is the effect yarn for the warp. The fill includes alternating picks of 650 denier high melt polypropylene as an effect yarn and stabilizing yarns formed of ends of polyester and polyethylene air textured together at deniers of 625 and 1,300. The fill yarns are introduced at 16–20 picks per inch.

Sample 16 utilizes 50 denier polyester as the effect yarn for the warp. The fill includes alternating picks of 650 denier high melt polypropylene as an effect yarn and stabilizing yarns again formed of ends of polyester and polyethylene air textured together. Preferred sizes of the stabilizing yarn are 625 denier and 1,300 denier. The fill yarns are introduced at 30–36 picks per inch.

Sample 17 utilizes 18/2 acrylic yarns as the effect yarn for the warp. The fill includes alternating picks of 18/2 acrylic effect yarn and stabilizing yarns formed of ends of 18/2 acrylic and polyethylene air textured together. Preferably, the 18/2 acrylic is textured with two ends of 250 denier polyethylene. The fill yarns are introduced at 16–38 picks per inch.

Sample 18 utilizes 220 denier high melt polypropylene as the effect yarn for the warp. The fill again includes alternating picks of 18/2 acrylic as an effect yarn and stabilizing yarns formed of ends of 18/2 acrylic and polyethylene air textured together. In this embodiment an end of 18/2 acrylic is textured with two ends of 650 denier polyethylene. The fill yarns are introduced at 16–30 picks per inch.

Sample 19 utilizes 50 denier polyester as the effect yarn for the warp. The fill includes alternating picks of 18/2 acrylic as an effect yarn and stabilizing yarns formed of ends of 18/2 acrylic and polyethylene air textured together. Preferably, one end of 18/2 acrylic is textured with two ends of 250 d polyethylene. The fill yarns are introduced at 30–36 picks per inch.

Sample 20 utilizes 18/2 acrylic as the effect yarn for the warp. The fill includes alternating picks of 18/2 acrylic as an effect yarn and stabilizing yarns each stabilizing yarn formed of one end of 8/1 acrylic and polyethylene. Preferably, each 8/1 acrylic end is textured with two ends of 250 denier polyethylene. The fill yarns are introduced at 8–28 picks per inch.

Sample 21 utilizes 220 denier high melt polypropylene as the effect yarn for the warp. The fill includes alternating picks of 18/2 acrylic as an effect yarn and stabilizing yarns formed of ends of 8/1 acrylic and polyethylene. Preferably, the 8/1 acrylic ends are air textured together with two ends of 650 denier polyethylene. The fill yarns are air textured at 30 picks per inch.

Sample 22 utilizes 650 denier high melt polypropylene yarns as the effect yarn for the warp. The fill includes alternating picks of 18/2 acrylic as an effect yarn and stabilizing yarns formed of ends of 8/1 acrylic and polyethylene air textured together. Preferred sizes of the stabilizing yarn for this example include one end of 8/1 acrylic textured with two ends of 650 denier polyethylene. The fill yarns may be introduced from 16–20 picks per inch.

Sample 23 utilizes 18/2 acrylic as the effect yarn for the warp. The fill includes alternating picks of 18/2 acrylic as an effect yarn and stabilizing yarns formed of ends of 8/1 acrylic and polyethylene air textured together. Preferred sizes of the stabilizing yarn are a single end of 8/1 acrylic textured with two ends of 650 denier polyethylene.

Sample 24 utilizes 50 denier polyester as the effect yarn for the warp. The fill includes alternating picks of 18/2 acrylic as an effect yarn and stabilizing yarns formed of ends of 8/1 acrylic and polyethylene. Preferably, a single end of 8/1 acrylic is air textured with two ends of 650 denier polyethylene. The fill yarns are introduced from 30–36 picks per inch.

Sample 25 utilizes 18/2 acrylic as the effect yarn for the warp. The fill includes all stabilizing yarns formed of two ends of 1,000 denier polyester and two ends of 220 denier polyethylene air textured together. The fill yarns are introduced at 20 picks per inch.

Sample 26 utilizes 18/2 acrylic yarn as the effect yarn for the warp. The fill includes all stabilizing yarns formed of ends of high melt polypropylene and polyethylene air textured together. The preferred size of this stabilizing yarn is 1,300 denier. The fill is introduced at 28 picks per inch.

Sample 27 is identical to Sample 26, except the stabilizing yarns are polyester/polyethylene.

Sample 28 utilizes 18/2 acrylic as the effect yarn for the warp. The fill includes stabilizing yarns and effect yarns at an insertion pattern of 1:3. The stabilizing yarns are formed of high melt polypropylene and polyethylene air textured together. The effect yarn in the fill is 18/2 acrylic. The stabilizing yarns may have a denier of either 625 or 1,300. The fill yarns are introduced at 28 picks per inch.

Sample 29 is identical to Sample 28, except the insertion pattern of stabilizing yarns and effect yarns is 1:6.

Sample 30 is identical to Sample 28, except the effect yarn in the fill is high melt polypropylene.

Sample 31 utilizes 18/2 acrylic as the effect yarn for the warp. The fill includes two yarn ends formed of 18/2 acrylic as an effect yarn followed by a stabilizing end formed of high melt polypropylene and polyethylene. The stabilizing yarn may be either 625 denier or 1,300 denier. The fill yarns are introduced at 34 picks per inch.

All of the above paragraphs 7–30 provide good results in abrasion resistance, seam slippage and raveling resulting from the cross-flow of the low melt constituent during the tentering operation.

Although the present invention has been described with preferred embodiments, it is to be understood that modifications and variations maybe utilized without departing from the spirit and scope of the invention, as those skilled in the art will readily understand. Such modifications and variations may be utilized without departing from the spirit and scope of the invention, as those skilled in the art will readily understand. Such modifications and variations are considered to be within the purview and scope of the pending claims and their equivalents.

We claim:

1. Decorative fabric for use in outdoor environments comprising:

a. a woven structure of warp and fill yarns;

b. said warp yarns being high melt effect yarns selected from the group consisting of acrylic, nylon, polyester, and high melt polypropylene;

c. at least some of said fill yarns being stabilizing yarns formed of both high-melt and low-melt yarn constituents wherein said high melt constituent is selected from the group consisting of high melt polypropylene, polyester, nylon and acrylic; and said low melt constituent is selected from the group consisting of polyethylene and low melt polypropylene;

d. said low-melt constituent being melted and bonded to other fibers in said fill yarns and causing said fill yarns to bond to said warp yarns at intersections thereof;

e. whereby said fabric achieves enhanced abrasion resistance, stability, resistance to seam slippage, and load recover without the need for a latex backing.

2. The fabric according to claim 1 wherein said woven structure includes a fill insertion ratio of stabilizing yarns to effect yarns selected from the group consisting of 1:1; 1:2; 1:3; 1:6 and 100% stabilizing yarns.

3. The fabric according to claim 1 wherein the melt temperature of said low-melt constituents is in the range of 240–280° F.

4. The fabric according to claim 3 wherein the melt temperature of said high-melt constituents is in the range of 300–340° F.

5. The fabric of claim 1 wherein the amount of said low-melt constituent in said stabilizing yarns is in the range of 10%–50% of the weight of the yarn.

6. The fabric of claim 1 wherein said stabilizing yarns are blended yarns having low-melt fibers blended with high-melt fibers.

7. The fabric of claim 1 wherein said stabilizing yarns are composite yarns having at least one low-melt end combined with at least one high melt end.

8. Decorative fabric for use in outdoor environments comprising:

a. a woven structure of warp and fill yarns;

b. said warp yarns being acrylic effect yarns;

c. said fill yarns comprising both stabilizing yarns and effect yarns, said stabilizing yarns comprising a composite yarn having a polyethylene low melt yarn (10%–50% by weight) combined with high melt polypropylene (90%–50% by weight) as high melt constituent air textured therewith, and said effect fill yarns comprising high melt polypropylene;

d. wherein in said fill yarn pattern, the stabilizing yarns are alternated with said effect yarns in a 1×1 insertion pattern;

e. wherein said polyethylene of said stabilizing yarns has a melt temperature below the temperature to which said fabric is subjected during tentering; and f. whereupon when melted, said polyethylene bonds to other fibers in said fill and warp yarns.

9. Decorative fabric for use in outdoor environments comprising:

a. a woven structure of warp and fill yarns;

b. said warp yarns being high melt polypropylene effect;

c. said fill yarns comprising both stabilizing yarns and effect yarns, said stabilizing yarns comprising a composite yarn having a polyethylene (10%–50% by weight) as the low melt yarn combined with high melt polypropylene (90%–50% by weight) as high melt constituent air textured therearound, and said effect fill yarns comprising acrylic;

d. wherein in said fill yarns patter, the stabilizing yarns are alternated with said effect yarns in a 1×1 insertion pattern;

e. wherein said polyethylene constituent of said stabilizing yarns has a melt temperature below the temperature to which said fabric is subjected during tentering; and f. whereupon, when melted, said polyethylene bonds to other fibers in said fill and warp yarns.

10. Decorative fabric for use in outdoor environments comprising:

a. a woven structure of warp and fill yarns;

b. said warp yarns being acrylic effect yarns;

c. said fill yarns comprising both stabilizing yarns and effect yarns, said stabilizing yarns comprising a composite yarn having a polyethylene low melt yarn combined with high melt polypropylene as the high melt constituent air textured therewith, and said effect fill yarns comprising acrylic;

d. wherein said fill yarn pattern, the stabilizing yarns are alternated with the said effect yarns in a 1×1 insertion pattern;

e. wherein said polyethylene constituent of said stabilizing yarns has a melt temperature below the temperature to which said fabric is subjected during tentering; and f. whereupon said polyethylene melts and cross-flows to other fibers in said fill and warp yarns.

11. Decorative fabric for use in outdoor environments comprising:

a. a woven structure of warp and fill yarns;

b. said warp yarns being high melt polypropylene effect yarns;

c. said fill yarns comprising both stabilizing yarns and effect yarns, said stabilizing yarns comprising a composite yarn having a polyethylene low melt yarn combined with high melt polypropylene as the high melt constituent air textured therewith, and said effect fill yarns comprising high melt polypropylene;

d. wherein said fill yarn pattern, the stabilizing yarns are alternated with the said effect yarns in a 1×1 insertion pattern;

e. wherein said polyethylene of said stabilizing yarns has a melt temperature below the temperature to which said fabric is subjected during tentering; and f. whereupon said polyethylene melts and cross-flows to other fibers in said fill and warp yarns.

12. Decorative fabric for use in outdoor environments comprising:

a. a woven structure of warp and fill yarns;

b. said warp yarns being polyester effect yarns;

c. said fill yarns comprising both stabilizing yarns and effect yarns, said stabilizing yarns comprising a composite yarn having a polyethylene low melt yarn combined with high melt polypropylene as the high melt constituent air textured therewith, and said effect fill yarns comprising high melt polypropylene;

d. wherein said fill yarn pattern, the stabilizing yarns are alternated with the said effect yarns in a 1×1 insertion pattern;

e. wherein said polyethylene of said stabilizing yarns has a melt temperature below the temperature to which said fabric is subjected during tentering; and f. whereupon said polyethylene melts and cross-flows to other fibers in said fill and warp yarns.

13. Decorative fabric for use in outdoor environments comprising:

a. a woven structure of warp and fill yarns;

b. said warp yarns being acrylic effect yarns;

c. said fill yarns comprising both stabilizing yarns and effect yarns, said stabilizing yarns having a denier of at least 600 d and comprising a composite yarn having a polyethylene low melt yarn combined with polyester as the high melt constituent air textured therewith, and said effect fill yarns comprising high melt polypropylene;

d. wherein said fill yarn pattern, the stabilizing yarns are alternated with the said effect yarns in a 1×1 insertion pattern;

e. wherein polyethylene of said stabilizing yarns has a melt temperature below the temperature to which said fabric is subjected during tentering; and g. whereupon said polyethylene melts and cross-flows to other fibers in said fill and warp yarns.

14. Decorative fabric for use in outdoor environments comprising:

a. a woven structure of warp and fill yarns;

b. said warp yarns being high melt polypropylene effect yarns;

c. said fill yarns comprising both stabilizing yarns and effect yarns, said stabilizing yarns comprising a composite yarn having a polyethylene low melt yarn combined with polyester as the high melt constituent air textured therearound, and said effect fill yarns comprising acrylic;

d. wherein said fill yarn pattern, the stabilizing yarns are alternated with the said effect yarns in a 1×1 insertion pattern;

e. wherein said polyethylene of said stabilizing yarns has a melt temperature below the temperature to which said fabric is subjected during tentering; and f. whereupon said polyethylene melts and cross-flows to other fibers in said fill and warp yarns.

15. Decorative fabric for use in outdoor environments comprising:

a. a woven structure of warp and fill yarns;

b. said warp yarns acrylic effect yarns;

c. said fill yarns comprising both stabilizing yarns and effect yarns, said stabilizing yarns comprising a composite yarn having a polyethylene low melt yarn combined with polyester as the high melt constituent air textured therewith, and said effect fill yarns comprising acrylic;

d. wherein said fill yarn pattern, the stabilizing yarns are alternated with the said effect yarns in a 1×1 insertion pattern;

e. wherein said polyethylene of said stabilizing yarns has a melt temperature below the temperature to which said fabric is subjected during tentering; and f. whereupon said polyethylene melts and cross-flows to other fibers in said fill and warp yarns.

16. Decorative fabric for use in outdoor environments comprising:

a. a woven structure of warp and fill yarns;

b. said warp yarns being high melt polypropylene effect yarns;

c. said fill yarns comprising both stabilizing yarns and effect yarns, said stabilizing yarns comprising a composite yarn having a polyethylene low melt yarn combined with polyester as the high melt constituent air textured therewith, and said effect fill yarns comprising high melt polypropylene;

d. wherein said fill yarn pattern, the stabilizing yarns are alternated with the said effect yarns in a 1×1 insertion pattern;

e. wherein said polyethylene of said stabilizing yarns has a melt temperature below the temperature to which said fabric is subjected during tentering; and g. whereupon said polyethylene melts and cross-flows to other fibers in said fill and warp yarns.

17. Decorative fabric for use in outdoor environments comprising:

a. a woven structure of warp and fill yarns;

b. said warp yarns being polyester effect yarns;

c. said fill yarns comprising both stabilizing yarns and effect yarns, said stabilizing yarns comprising a composite yarn having a polyethylene low melt yarn combined with polyester as the high melt constituent air textured therewith, and said effect fill yarns comprising high melt polypropylene;

d. wherein said fill yarn pattern, the stabilizing yarns are alternated with the said effect yarns in a 1×1 insertion pattern;

e. wherein said polyethylene of said stabilizing yarns has a melt temperature below the temperature to which said fabric is subjected during tentering; and f. whereupon said polyethylene melts and cross-flows to other fibers in said fill and warp yarns.

18. Decorative fabric for use in outdoor environments comprising:

a. a woven structure of warp and fill yarns;

b. said warp yarns being acrylic effect yarns;

c. said fill yarns comprising both stabilizing yarns and effect yarns, said stabilizing yarns comprising a composite yarn having two ends of polyethylene low melt yarn combined with acrylic as the high melt constituent air textured therewith, and said effect fill yarns comprising acrylic;

d. wherein said fill yarn pattern, the stabilizing yarns are alternated with the said effect yarns in a 1×1 insertion pattern;

e. wherein said polyethylene of said stabilizing yarns has a melt temperature below the temperature to which said fabric is subjected during tentering; and f. whereupon said polyethylene melts and cross-flows to other fibers in said fill and warp yarns.

19. Decorative fabric for use in outdoor environments comprising:

a. a woven structure of warp and fill yarns;

b. said warp yarns being high melt polypropylene effect yarns;

c. said fill yarns comprising both stabilizing yarns and effect yarns, said stabilizing yarns comprising a composite yarn having two ends of polyethylene low melt yarn combined with acrylic as the high melt constituent air textured therewith, and said effect fill yarns comprising acrylic;

d. wherein said fill yarn pattern, the stabilizing yarns are alternated with the said effect yarns in a 1×1 insertion pattern;

e. wherein said polyethylene of said stabilizing yarns has a melt temperature below the temperature to which said fabric is subjected during tentering; and f. whereupon said polyethylene melts and cross-flows to other fibers in said fill and warp yarns.

20. Decorative fabric for use in outdoor environments comprising:

a. a woven structure of warp and fill yarns;

b. said warp yarns being polyester effect yarns;

c. said fill yarns comprising both stabilizing yarns and effect yarns, said stabilizing yarns comprising a composite yarn having two ends of polyethylene low melt yarn combined with acrylic as the high melt constituent air textured therewith, and said effect fill yarns comprising acrylic;

d. wherein said fill yarn pattern, the stabilizing yarns are alternated with the said effect yarns in a 1×1 insertion pattern;

e. wherein said polyethylene of said stabilizing yarns has a melt temperature below the temperature to which said fabric is subjected during tentering; and f. whereupon said polyethylene melts and cross-flows to other fibers in said fill and warp yarns.

21. Decorative fabric for use in outdoor environments comprising:

a. a woven structure of warp and fill yarns;

b. said warp yarns being acrylic effect yarns;

c. said fill yarns comprising both stabilizing yarns and effect yarns, said stabilizing yarns comprising a composite yarn having a polyethylene low melt yarn combined with acrylic yarn as the high melt constituent air textured therewith, and said effect fill yarns comprising acrylic;

d. wherein said fill yarn pattern, the stabilizing yarns are alternated with the said effect yarns in a 1×1 insertion pattern;

e. wherein said polyethylene of said stabilizing yarns has a melt temperature below the temperature to which said fabric is subjected during tentering; and f. whereupon said polyethylene melts and cross-flows to other fibers in said fill and warp yarns.

22. Decorative fabric for use in outdoor environments comprising:

a. a woven structure of warp and fill yarns;

b. said warp yarns being high melt polypropylene effect yarns;

c. said fill yarns comprising both stabilizing yarns and effect yarns, said stabilizing yarns comprising a composite yarn having two ends of polyethylene low melt yarn combined with an end of acrylic yarn as the high melt constituent air textured therewith, and said effect fill yarns comprising acrylic;

d. wherein said fill yarn pattern, the stabilizing yarns are alternated with the said effect yarns in a 1×1 insertion pattern;

e. wherein said polyethylene of said stabilizing yarns has a melt temperature below the temperature to which said fabric is subjected during tentering; and f. whereupon said polyethylene melts and cross-flows to other fibers in said fill and warp yarns.

23. Decorative fabric for use in outdoor environments comprising:

a. a woven structure of warp and fill yarns;

b. said warp yarns being high melt polypropylene effect yarns;

c. said fill yarns comprising both stabilizing yarns and effect yarns, said stabilizing yarns comprising a composite yarn having two ends of polyethylene low melt yarn combined with one end of acrylic as the high melt constituent air textured therewith, and said effect fill yarns comprising acrylic;

d. wherein said fill yarn pattern, the stabilizing yarns are alternated with the said effect yarns in a 1×1 insertion pattern;

e. wherein said polyethylene of said stabilizing yarns has a melt temperature below the temperature to which said fabric is subjected during tentering; and f. whereupon said polyethylene melts and cross-flows to other fibers in said fill and warp yarns.

24. Decorative fabric for use in outdoor environments comprising:

a. a woven structure of warp and fill yarns;

b. said warp yarns being acrylic effect;

c. said fill yarns comprising both stabilizing yarns and effect yarns, said stabilizing yarns comprising a composite yarn having two ends of polyethylene low melt yarn combined with one end of acrylic as the high melt constituent air textured therearound, and said effect fill yarns comprising acrylic;

d. wherein said fill yarn pattern, the stabilizing yarns are alternated with the said effect yarns in a 1×1 insertion pattern;

e. wherein said polyethylene of said stabilizing yarns has a melt temperature below the temperature to which said fabric is subjected during tentering; and f. whereupon said polyethylene melts and cross-flows to other fibers in said fill and warp yarns.

25. Decorative fabric for use in outdoor environments comprising:

a. a woven structure of warp and fill yarns;

b. said warp yarns being polyester effect yarns;

c. said fill yarns comprising both stabilizing yarns and effect yarns, said stabilizing yarns comprising a composite yarn having two ends of polyethylene low melt yarn combined with one end of acrylic as the high melt constituent air textured therewith, and said effect fill yarns comprising acrylic;

d. wherein said fill yarn pattern, the stabilizing yarns are alternated with the said effect yarns in a 1×1 insertion pattern;

e. wherein said polyethylene of said stabilizing yarns has a melt temperature below the temperature to which said fabric is subjected during tentering; and f. whereupon said polyethylene melts and cross-flows to other fibers in said fill and warp yarns.

26. Decorative fabric for use in outdoor environments comprising:

a. a woven structure of warp and fill yarns;

b. said warp yarns being acrylic effect yarns;

c. said fill yarns comprising all stabilizing yarns comprising a composite yarn having two ends of polyethylene low melt yarn combined with two ends of polyester as the high melt constituent air textured;

d. wherein said fill yarn pattern, the stabilizing yarns are alternated with the said effect yarns in a 1×1 insertion pattern;

e. wherein said polyethylene of said stabilizing yarns has a melt temperature below the temperature to which said fabric is subjected during tentering; and f. whereupon said polyethylene melts and cross-flows to other fibers in said fill and warp yarns.

27. Decorative fabric for use in outdoor environments comprising:

a. a woven structure of warp and fill yarns;

b. said warp yarns being acrylic effect yarns;

c. said fill yarns comprising all stabilizing yarns comprising a composite yarn having a polyethylene low melt yarn combined with high melt polypropylene as the high melt constituent air textured therewith;

d. wherein said polyethylene of said stabilizing yarns has a melt temperature below the temperature to which said fabric is subjected during tentering; and e. whereupon said polyethylene melts and cross-flows to other fibers in said fill and warp yarns.

28. Decorative fabric for use in outdoor environments comprising:

a. a woven structure of warp and fill yarns;

b. said warp yarns being acrylic effect yarns;

c. said fill yarns comprising all stabilizing yarns comprising a composite yarn having a polyethylene low melt yarn combined with polyester as the high melt constituent air textured therewith;

d. wherein said polyethylene of said stabilizing yarns has a melt temperature below the temperature to which said fabric is subjected during tentering; and e. whereupon said polyethylene melts and cross-flows to other fibers in said fill and warp yarns.

29. Decorative fabric for use in outdoor environments comprising:

a. a woven structure of warp and fill yarns;

b. said warp yarns being acrylic effect yarns;

c. said fill yarns comprising both stabilizing yarns and effect yarns, said stabilizing yarns comprising a composite yarn having a polyethylene low melt yarn combined with high melt polypropylene as the high melt constituent air textured therewith; and said effect fill yarns comprising acrylic;

d. wherein said fill yarn pattern, the stabilizing yarns are alternated with the said effect yarns in a 1×3 insertion pattern;

e. wherein said polyethylene of said stabilizing yarns has a melt temperature below the temperature to which said fabric is subjected during tentering; and f. whereupon said polyethylene melts and cross-flows to other fibers in said fill and warp yarns.

30. Decorative fabric for use in outdoor environments comprising:

a. a woven structure of warp and fill yarns;

b. said warp yarns being acrylic effect yarns;

c. said fill yarns comprising both stabilizing yarns and effect yarns, said stabilizing yarns comprising a composite yarn having a polyethylene low melt yarn combined with high melt polypropylene as the high melt constituent air textured therewith, and said effect fill yarns comprising acrylic;

d. wherein said fill yarn pattern, the stabilizing yarns are alternated with the said effect yarns in a 1×6 insertion pattern;

e. wherein said polyethylene of said stabilizing yarns has a melt temperature below the temperature to which said fabric is subjected during tentering; and f. whereupon said polyethylene melts and cross-flows to other fibers in said fill and warp yarns.

31. Decorative fabric for use in outdoor environments comprising:

a. a woven structure of warp and fill yarns;

b. said warp yarns being acrylic effect yarns;

c. said fill yarns comprising both stabilizing yarns and effect yarns, said stabilizing yarns comprising a composite yarn having a polyethylene low melt yarn combined with high melt polypropylene as the high melt constituent air textured therewith, and said effect fill yarns comprising acrylic;

d. wherein said fill yarn pattern, the stabilizing yarns are alternated with the said effect yarns in a 1×3 insertion pattern;

e. wherein said polyethylene of said stabilizing yarns has a melt temperature below the temperature to which said fabric is subjected during tentering; and f. whereupon said polyethylene melts and cross-flows to other fibers in said fill and warp yarns.

32. Decorative fabric for use in outdoor environments comprising:

a. a woven structure of warp and fill yarns;

b. said warp yarns being acrylic effect yarns;

c. said fill yarns comprising both stabilizing yarns and effect yarns, said stabilizing yarns comprising a composite yarn having a polyethylene low melt yarn combined with high melt polypropylene as the high melt constituent air textured therewith, and said effect fill yarns comprising acrylic;

d. wherein said fill yarn pattern, the stabilizing yarns are alternated with the said effect yarns in a 1×2 insertion pattern;

e. wherein said polyethylene of said stabilizing yarns has a melt temperature below the temperature to which said fabric is subjected during tentering; and f. whereupon said polyethylene melts and cross-flows to other fibers in said fill and warp yarns.

* * * * *